United States Patent [19]

Mackie

[11] 4,327,910

[45] May 4, 1982

[54] ARM WRESTLING DEVICE

[76] Inventor: Glenn E. Mackie, Star Rte. Box 117-A, Limestone, Me. 04750

[21] Appl. No.: 128,270

[22] Filed: Mar. 7, 1980

[51] Int. Cl.[3] ..... A63B 21/02

[52] U.S. Cl. ..... 273/1 GI

[58] Field of Search ..... 273/1 R, 1 E, 1 M, 126 R, 273/126A, DIG. 26, 191 R, 125 A, 1 GC, 1 GD, 1 GI; 272/67; 194/1 R, DIG. 11, DIG. 22, DIG. 23

[56] References Cited

U.S. PATENT DOCUMENTS

| | | | |
|---|---|---|---|
| 3,228,688 | 1/1966 | Dennison | 273/125 A X |
| 3,604,712 | 9/1971 | Prior et al. | 273/191 R X |
| 3,817,519 | 6/1974 | Leonhart | 273/126 A X |
| 4,148,555 | 4/1979 | Lerman | 273/DIG. 26 X |
| 4,176,837 | 12/1979 | Jeffrey et al. | 273/1 R |
| 4,220,330 | 9/1980 | Montgomery | 273/DIG. 26 X |

*Primary Examiner*—Paul E. Shapiro

*Attorney, Agent, or Firm*—W. R. Hulbert

[57] ABSTRACT

A coin-operated arm wrestling device provides a table top, adjustable for height, having a "playing surface" to support the elbows of a pair of contestants, means at each end of the surface to register "falls," score signalling and keeping means and playing surface interrupting means to spoil the elbow supporting surface when a predetermined number of falls have been registered. The device is suitable for use in recreation centers and the like.

3 Claims, 16 Drawing Figures

ARM WRESTLING DEVICE

BACKGROUND OF THE INVENTION

Arm wrestling tables are known per se, used for national championship contests, promotional activities and the like. Such a table is constructed and arranged merely to provide a suitable elbow supporting surface. Officials are chosen to judge the contest and select the winner.

So far as I am aware, no one has proposed an independent device which does not require officials or judges by providing an elbow supporting surface for the contestants and automatic scoring means to count the "falls," the mechanism being activated by coin operated means, allowing only a predetermined number of falls for insertion of a single coin, and having automatic disabling means for rendering the elbow supporting surface unusable and locking the remaining mechanisms pending insertion of another coin.

Accordingly, it is the object of the invention to provide just such a device which is particularly adaptable for use in recreation centers, arcades, pubs, youth centers, health centers, and the like. Its function is both recreational and an incentive to develop health through physical fitness.

SHORT STATEMENT OF THE INVENTION

In accordance with the invention, in its broadest aspect, there is provided a novel arm wrestling apparatus comprising a table provided with an elbow supporting flat surface for the elbows of a pair of contestants, sensing means mutually spaced on such surface arranged to be engaged by the hand, wrist or forearm of a losing contestant, and means responsive to the sensing means for signalling the scoring of a point in favor of the winner.

The invention also encompasses one or more of the following additional features singly and in various combinations: scoring means actuated by the sensing means for keeping the score of points scored; means for rendering the elbow supporting flat surface unusable in the absence of a predetermined signal; means for disabling the sensing means in the absence of such predetermined signal; the means for rendering said surface unusable comprising retractable surface interrupting elements; coin operated means for generating the predetermined signal; means for adjusting the height of the elbow supporting surface; the use of a series of pins extendable from beneath through apertures in said table for the retractable surface interrupting elements; audible means, such as a bell or gong, for signalling the scoring of a point; rod means actuated by the sensing means for ringing the bell or gong; means for returning the elbow supporting surface to unusable condition after a predetermined number of points have been scored; said sensing means comprising a pair of yieldable pads, each movable with respect to the table surface and preferably hinged thereto and angularly adjustable, adapted to move from an elevated position to a depressed position when engaged by a portion of a contestant's arm, together with rod means interconnecting the pads and the point scoring means to actuate the latter; scoring means activated by movements of the said rod means for keeping score of the points scored; means for counting the total number of points scored and activating the means for rendering the elbow supporting surface unusable after a predetermined number of points have been scored; the use of coin operated means for generating the predetermined signal so as to render said surface usable after the insertion of a coin; means for displaying the adjusted height of the elbow supporting surface to the contestants, preferably by a color coded or number index.

In a preferred embodiment, the novel arm wrestling apparatus features a table with an elbow supporting flat surface for the elbows of a pair of contestants, mutually spaced yieldable pads arranged on the surface to be engaged and depressed by the hand, wrist or forearm of the losing contestant, an audible signalling device to signal each point scored, a scoring device to keep score for each contestant, a counting device to count the aggregate number of points scored and linkage interconnecting the pads and the devices to actuate the latter.

The presently preferred embodiment further features retractable spoilers for the elbow supporting surface, means for locking the yieldable pads and interconnecting linkage and means to activate the locking means after a predetermined aggregate number of points have been scored, as well as coin operated means for retracting the spoilers and unlocking the yieldable pads and interconnecting linkage upon the insertion of a coin.

Further features include mounting the table on adjustable legs extending upward from a wide, flat, rigid base adapted to rest on the floor, the base having extended areas on either side of the table on which the contestants may stand, whereby the weight of the contestants will add to the stability of the apparatus when in use; color coding the top surfaces of the table and base to indicate to the conestants where to stand and the functions of any mechanisms mounted on the table top; and providing the top surface of the base with indicia to indicate to the contestants the purpose of the apparatus.

Still further objects, features and advantages of the invention will become apparent from the following detailed description of a presently preferred embodiment taken in conjunction with the accompanying drawings.

DETAILED DESCRIPTION OF PREFERRED EMBODIMENT

General Arrangement

Figure 1:
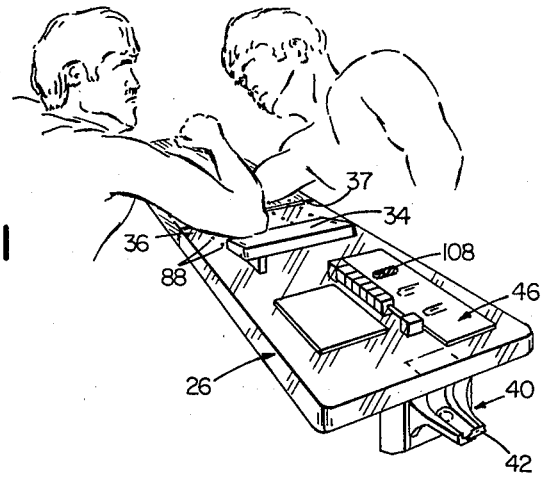
FIG. 1 is a view in perspective on a reduced scale of the table top of a preferred embodiment of the novel arm wrestling device showing it in use by a pair of contestants.
Figure 1A:
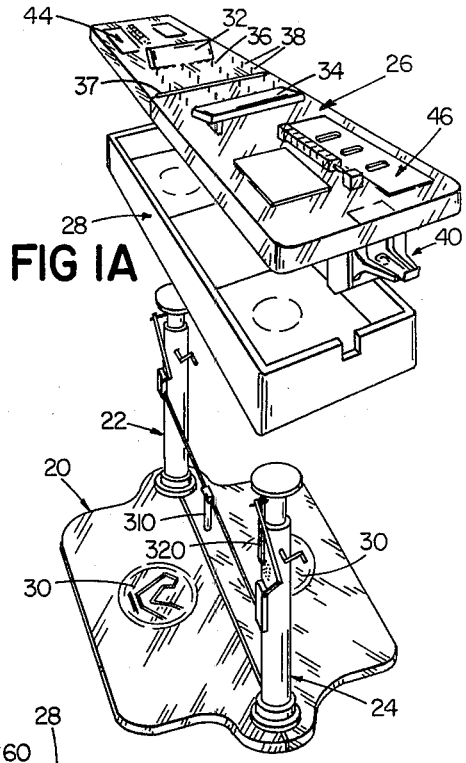
FIG. 1A is an exploded view in perspective showing the three major components of the device.
Figure 2:
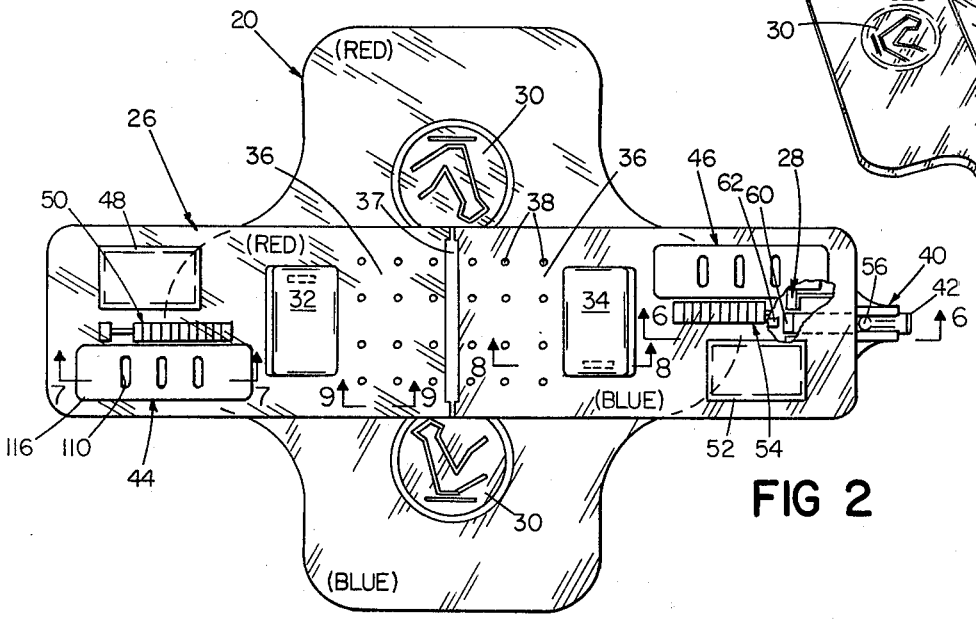
FIG. 2 is a plan view of the table top on a somewhat larger scale.
Figure 3:
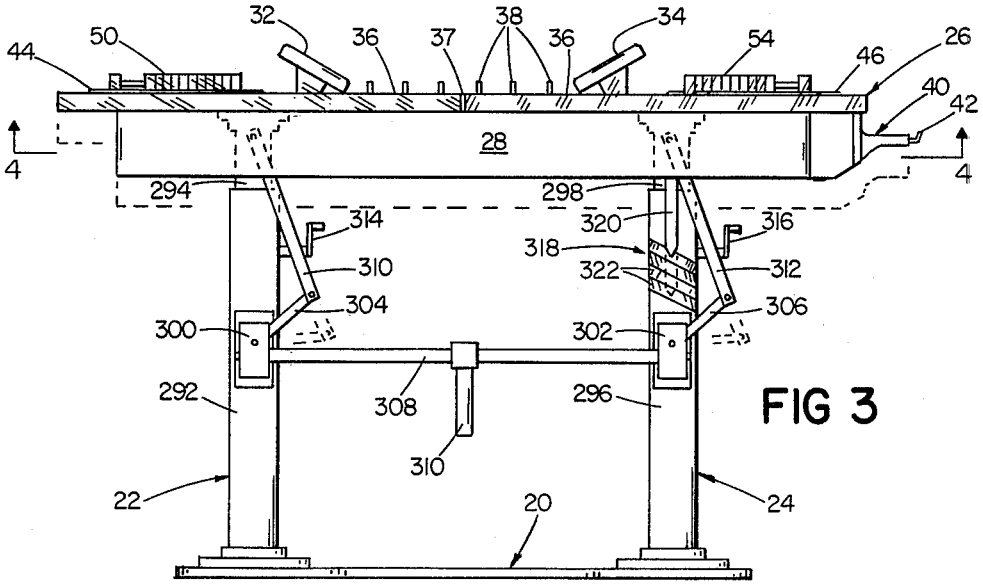
FIG. 3 is an elevation showing one side of the device.

The general arrangement of the novel arm wrestling device is apparent from FIGS. 1–3. Referring first to FIG. 1A, it will be seen that a platform 20 supports a pair of telescoping vertical legs or pedestals 22, 24 at the upper ends of which are mounted the wrestling table 26 and depending shroud 28 which conceals the working parts beneath the table. The platform 20 is sufficiently wide to provide adequate stability and standing room when the device is in use, being further stabilized by the weight of the contestants. The circular logo markings 30 tell the story that the machine is to be used for arm wrestling and locate the center of the board to the wrestlers when they approach the machine. The pedestals 22, 24 are provided with means for raising and lowering the table to suit contestants of different heights, as described below. A color coded device is desirably provided to indicate the height chosen for present and future reference. Preferably, the table top and platform are color-coded, in this case red and blue, to indicate to the contestants where to stand and which score indicator will register their points.

Figure 9:
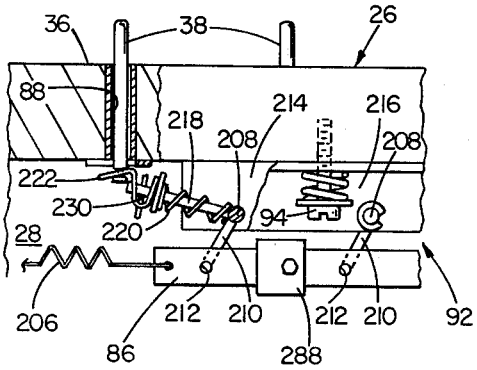
FIG. 9 is a section taken on line 9—9 of FIG. 2 showing the operation of the pin elevating and depressing means.

On the table top is a hingedly mounted pair of padded "trap doors" 32, 34. Between them is an elbow-supporting surface or playing field 36 on which the wrestlers rest their elbows while arm wrestling. The surface 36 is divided by center line 37 into two halves. Each half is interrupted by a series of protruding retractable pins which are operatively mounted in a pin assembly 92 including fixed bearing members 214, 216 which are attached to the bottom of the table 26 by fasteners 94 (FIG. 9). To unlock the mechanism, the combatants have first to insert a coin in coin chute 40 and then push in slide 42 which serves both to retract the pins 38 and release the trap door locking mechanism, so that either trap door will swing downwardly independently of the other when engaged by the wrist, hand or forearm of the losing contestant. The novel device also includes score keeping mechanisms 44, 46, one for each wrestler. The mechanism likewise provides means for disabling the device after a predetermined number of points have been scored, say three, after which another coin must be inserted if wrestling is to be resumed. The disabling means locks the trap doors against being depressed and causes the retracted pins to protrude and lock once more, spoiling the smooth surface of the playing field so that there can be no wrestling without first inserting a coin. Provision is also made for ringing a bell or gong for each point scored. The portions of the top surface of table 26 which are not involved with the mechanisms just described are preferably interrupted with other protruding means, such as at 48, 50, 52, 54 thereby to prevent the table ends from being used for arm wrestling free of charge.

With the foregoing in mind, we now proceed to describe the specific mechanisms which perform the several functions which are required.

Coin Operated Unlocking Function

Figure 4:
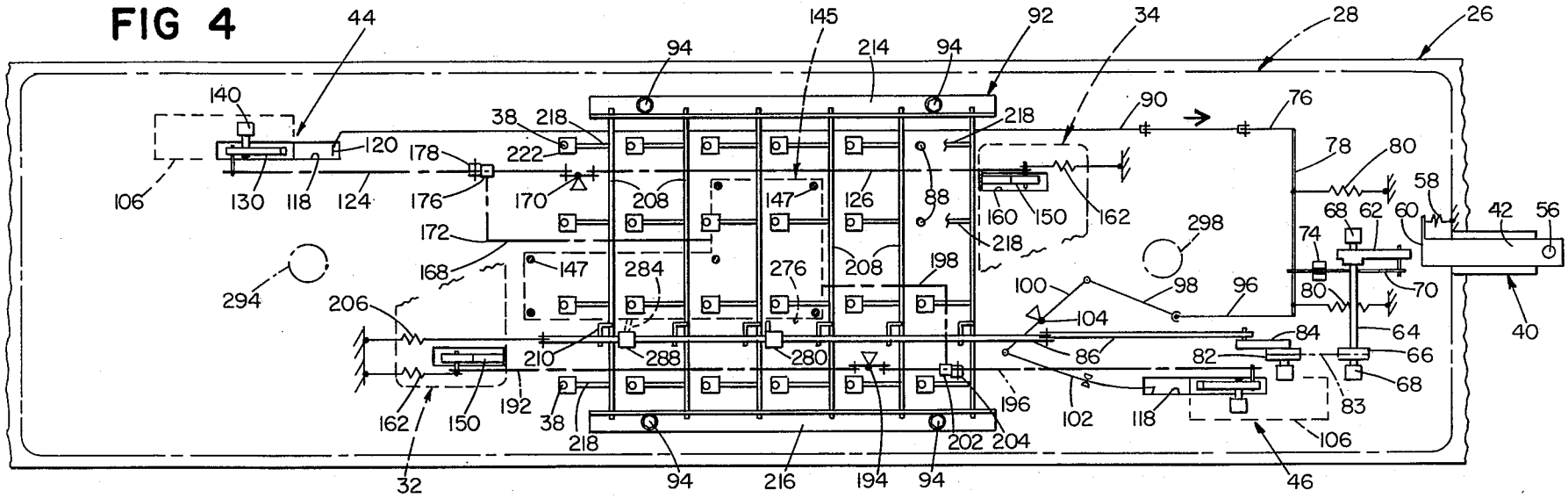
FIG. 4 is a largely schematic bottom view of the working components, as indicated by line 4—4 in FIG. 3, with the elements in the their locked position prior to being released by insertion of a coin in the coin chute.
Figure 5:
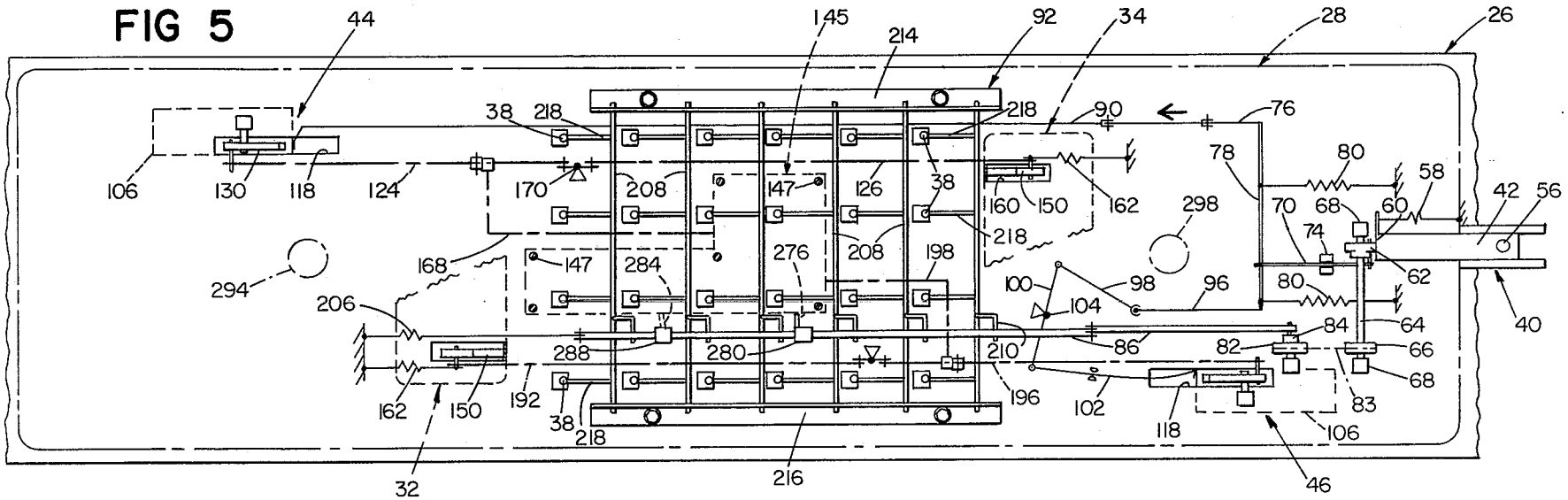
FIG. 5 is a view similar to that of FIG. 4 with the elements in their working position after actuation by insertion of a coin and advancing the activating slide.
Figure 6:
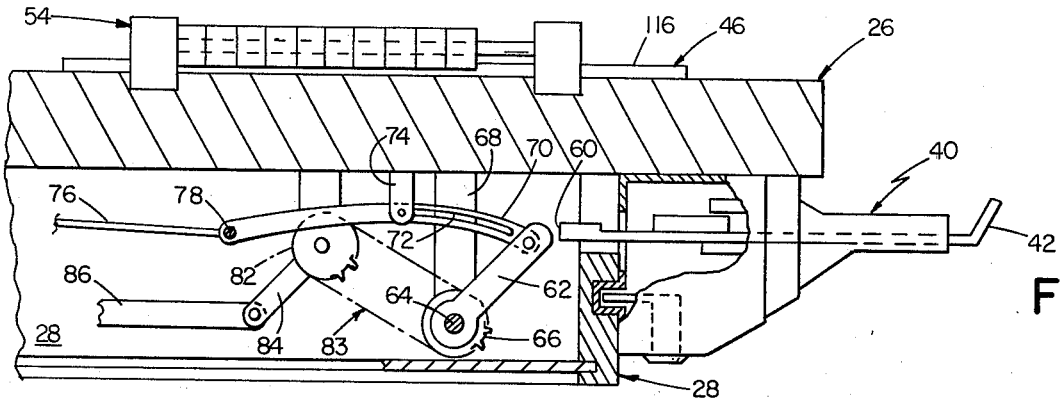
FIG. 6 is a section of the coin actuated drive portion of the device taken on line 6—6 of FIG. 2.

Referring to FIGS. 4, 5 and 6, to prepare the machine for arm wrestling a coin is placed in the slot 56 of slide 42. The slide is then pushed all the way forward within the chute 40 against the tension of return spring 58. The forward end 60 of the slide engages and swings crank 62 in a counterclockwise direction as seen in FIG. 6 thereby, through linkages described below, unlocking the trap doors 32, 34 and activating the pin assembly 92 to retract the pins 38. It will be seen that the mechanism beneath the table has been shifted from its position in FIG. 4 to its position for wrestling in FIG. 5.

Crank 62 is rigidly connected to revolve shaft 64 one end of which carries a sprocket 66. The shaft 64 is rotatably supported on the under side of the table 26 in bearings 68. Hinged to the outer end of crank 62 is an arcuate bar 70 which is supported in a slot 72 from the underside of the table by depending member 74 so that when the crank swings counterclockwise the bar 70 will shift the reset actuating bar 76 to the left as seen in FIG. 6. The bar 76 is connected to shaft 78 which is journaled in the left end of bar 70. In FIGS. 4 and 5 the bars and shafts have been indicated only diagrammatically for purposes of clarity. The shaft 78 is mounted in such a way that it can be bodily shifted to left and right between the positions shown in FIGS. 4 and 5, being urged toward the right hand position by springs 80 which are anchored to the bottom of the table. When retracted by the springs this bar serves to restore the scoring slides to zero position, as will later appear.

A second sprocket 82 is driven by chain 83 from sprocket 66 and carries an arm 84 which will also be swung counterclockwise when slide 42 is pushed all the way in. Arm 84 is connected rigidly to sprocket 82 so that it will swing in a counterclockwise direction with the sprocket and at the same time pull bar 86 to the right as seen in FIG. 6 thereby moving the components actuated by bar 86 to their positions shown in FIG. 5 in which position bar 86 is locked so as to hold the pins 38 retracted and the "trap doors" unlocked for play through a predetermined number of "falls". When the counting mechanism has counted the number of "falls" permitted by the insertion of a single coin, by mechanism to be described, the main actuating bar 86 is released, whereupon it is restored to its former position by the action of spring 206. This movement of bar 86 serves to extend the spoiler pins 38 and lock the "trap doors" so that arm wrestling cannot resume without the insertion of another coin again to unlock the mechanisms, retract the pins and release the "trap doors."

Score-keeping Mechanism

The operation of this mechanism will be described with particular reference to FIGS. 4, 5, 7, 8 and 11.

The actuation bar 76 is connected to rod 90 which runs under the length of the table and connects to and operates the score-keeping device 44 at the left hand end of the machine. Another linkage, actuated by bodily shifting bar 78, operates a similar device 46 at the right hand end of the machine. This linkage comprises rod 96 which swings linkage 98, 100, 102 to operate the scorer 46. The link 100 is pivoted about fulcrum 104 to reverse the direction of movement so that the counter will be driven in the right direction. Since both counters operate identically, the description will be confined to counter 44.

Figure 7:
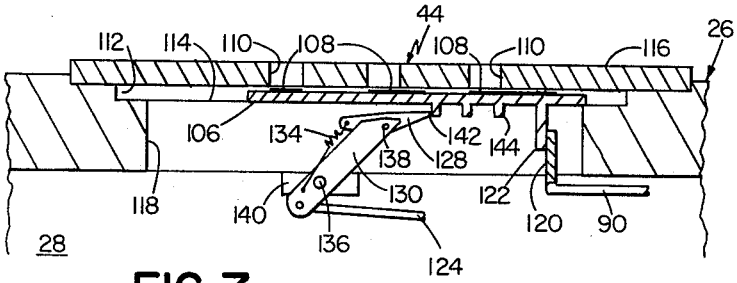
FIG. 7 is a section taken on line 7—7 of FIG. 2 showing one of the two scoring mechanisms.
Figure 11:
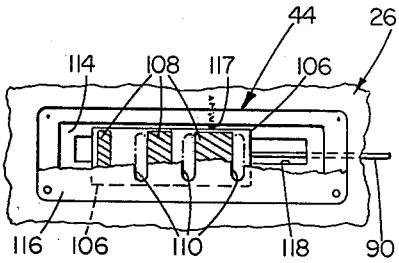
FIG. 11 is a fragmentary plan view with portions broken away of the mechanism shown in FIG. 7 for keeping score.
Figure 8:
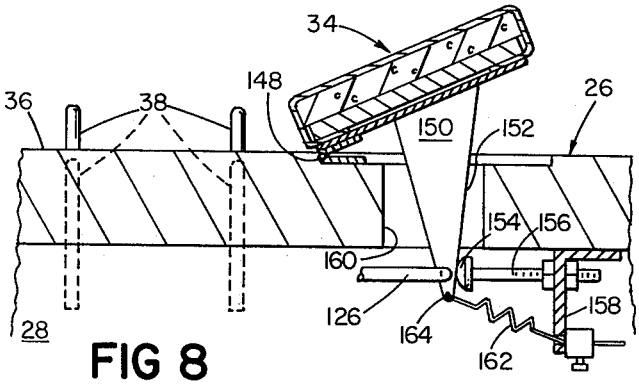
FIG. 8 is a section taken on line 8—8 of FIG. 2 showing the trap door type of arm pad which, when depressed, enters a score in favor of the winning participant.

The scoring device comprises a slide 106 provided with visual indicia 108 on its upper surface which are to be viewed through apertures 110 in apertured member 116 which covers opening 118 in the table 26. The slide 106 rides in slot 112 defined by the depressed surface 114 cut into the table top and the lower surface of apertured member 116. A tension device in the form of a coil spring 117 is arranged to bear against the side of slide 106 so that it will maintain its various adjusted positions against accidental movement. Rod 90 is connected to a pusher 120 which engages depending projection 122 of the slide 106. Upon the insertion of a coin in the coin chute and advancement of the slide 42, rod 90 is moved to the left as seen in FIG. 7 and pushes the slide 106 to its extreme left hand position. The dog 128 is pivoted to link 130 at 138 and the link 130 is pivoted to a support 140 mounted on the bottom of the table 26. The nose 142 of dog 128 is provided with a camming surface so that the projections will ride over it when the slide is reset by rod 90. The dog is urged to its operative position about pivot 138 by spring 134.

Having reset the counter by shifting the slide 106, as described, the device is prepared to keep score. This is accomplished by the linkages between the counter and the trap door 34 comprising rods 124 and 126 the former of which is arranged to actuate dog 128 through link 130. Upon depression of pad 34 against the restoring force of spring 162, by reason of a contestant forcing the forearm of his opponent down onto the pad, rod 124 shifts to the left as seen in FIG. 7, causing the dog 128 to move to the right and downwardly in a predetermined path whereby the forward edge of the dog engages one of the projections 144 to shift the slide 106 one step to the right as seen in FIG. 7. Each step changes the indicia visible through the openings 110. Thus the winner's score, in this case to a maximum of three, is shown by the appearance of the indicia through the openings 110. In the partly broken away plan view of FIG. 11 the slide 106 has been reset to starting position by rod 90 and hence none of the indica is visible through the slots 110 as seen in this view.

The scorer 46 is reset by the linkages 96, 98, 100, and 102 in the same manner as just described with respect to scoring device 44. It will be seen that the necessary reversal of direction of movement is accomplished by pivot 104 about which link 100 may swing in either direction. The indicia carrying slide of counter 46 is moved step by step to keep the score by depression of the trap door 32 through linkage 192, 196. In addition to the score keepers 44, 46, there are provided on the table surface a pair of cumulative scoring devices 50, 54 enabling the contestants to tally their scores beyond the three permitted for insertion of a single coin, including keeping team scores. The devices are similar to those used for keeping score in a pool hall, involving a number of beads sliding on rods as shown.

Trap-Door Operation and Bell

When one of the pads 32, 34 is depressed it not only actuates the appropriate counter but also rings a bell or gong 146. The bell ringing assembly is indicated generally by the numeral 145. It is supported by posts 147 depending from the bottom of the table 26. Referring particularly to FIGS. 8, 10 and 10A and 10B, it will be seen that the pad 34 is hinged at 148 to the surface of the table 26. When the trap door is sprung by reason of the forearm of one of the wrestlers forcing it down, depending arm 150, provided with a supporting surface 152, descends through opening 160 in table 26. The geometry is selected so that this movement forces rod 126 to the left against the force of restoring spring 162 as seen in FIG. 4. This motion of rod 126 rings the bell or gong 146 and also serves to move the counter 44 one step as above described. Spring 162, which is preferably adjustable as to tension, is connected between the bottom end of arm 150 and fixed bracket 158 so as to urge the "trap door" to its normal working position shown in FIG. 8. Back stop 154 is adjustably mounted on bracket 158 by means of bolt 156 for the purpose of establishing the angle of pad 34 in its raised position.

Figure 10:
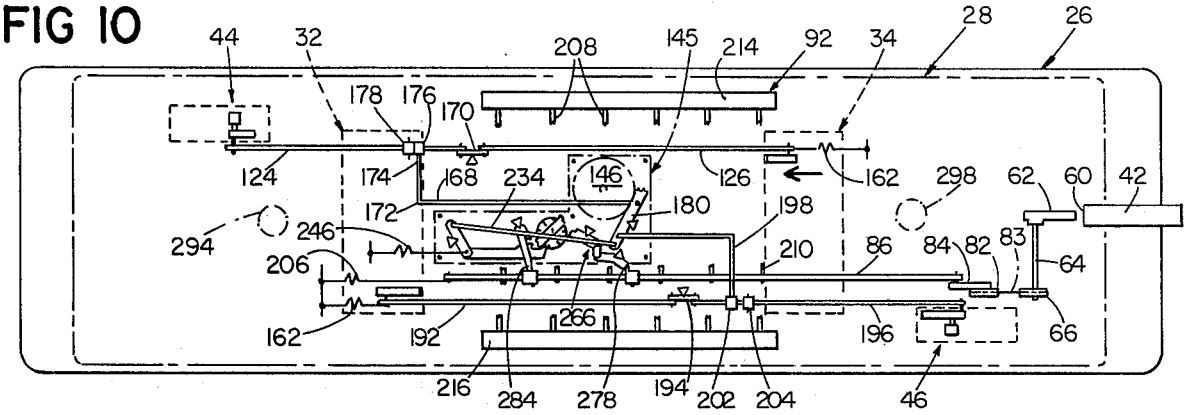
FIG. 10 is a schematic bottom view showing the operation of the scoring and bell ringing elements of the device.
Figure 10A:
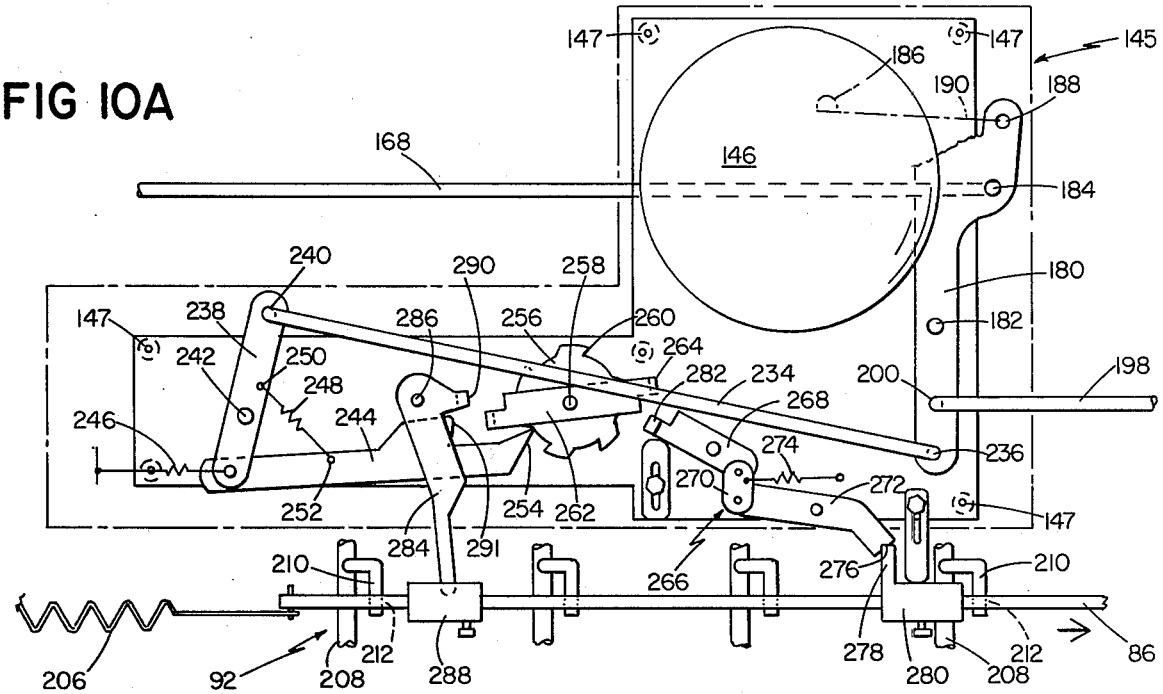
FIG. 10A is an enlargement of some of the elements shown in FIG. 10.
Figure 10B:
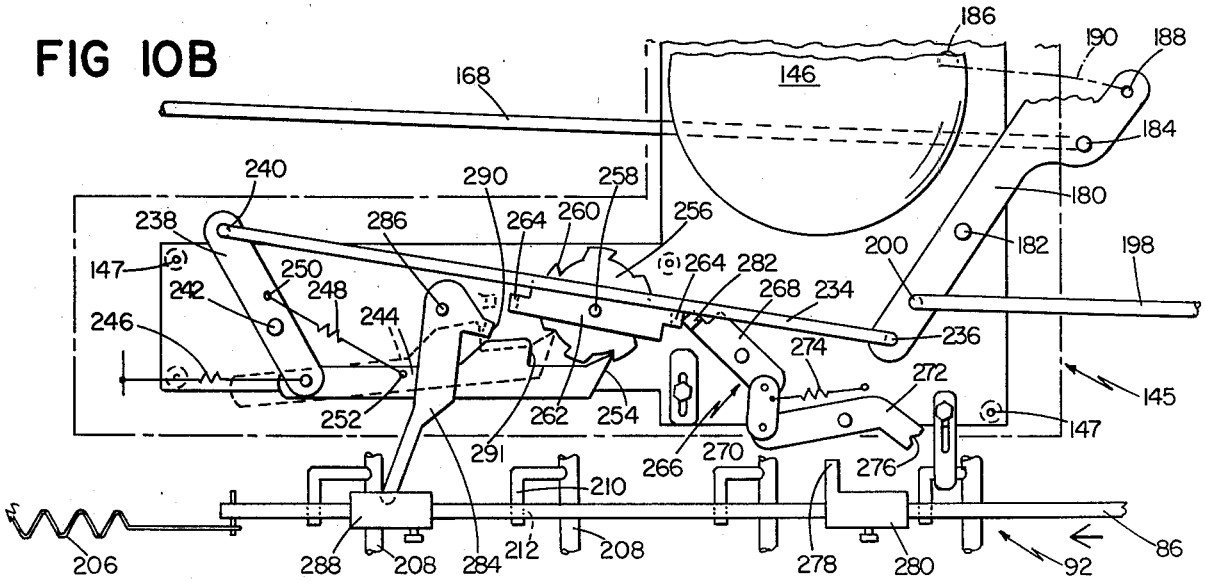
FIG. 10B is a view similar to FIG. 10A showing the elements in their position when a point is scored.

Referring to FIGS. 10, 10A and 10B, when rod 126 moves to the left it transmits reverse motion to rod 124 and bell ringing rod 168 by reason of the pivotal connection between rod 126 and 124 shown only schematically at 170. The rod 168 is bent ninety degrees at 172 and its end 174 is made slidable on rod 124 by means of sleeve 176 to which it is suitably affixed. A second sleeve 178 is rigidly affixed to rod 124 so as to move with it. When rod 124 moves to the right as seen in FIG. 10 sleeve 178 engages and correspondingly moves sleeve 176 and its rod 168. When rod 124 moves in the opposite direction, due to the lost motion, there is no corresponding movement of rod 168.

Referring to FIG. 10A, when rod 168, which is pinned to arm 180 at 184, moves to the right, it swings arm 180 about pin 182 thereby causing the clapper 186, which is connected at 188 by means 190 to the upper end of arm 180, to strike the inner surface of the bell 146 sounding a score for the contestant who forced his opponent's arm down on pad 34.

Pad 32 is, generally speaking, similarly linked to the bell striking mechanism. When trap door 32 is sprung, by mechanism essentially identical with that shown in FIG. 8, rod 192 is shifted to the right, as seen in FIG. 10, and its motion is reversed by pivot 194 so as to pull rod 196 to the left. A ninety degree bent rod 198 has one end connected to lever arm 180 at 200. Its other end terminates in sleeve 202 which slides on rod 196. A second sleeve 204 is clamped to rod 196 and moves with it. When rod 196 moves to the left (FIG. 10) it carries with it sleeve 204 which engages sleeve 202 and drives rod 198 to the left (FIG. 10A), pivoting arm 180 clockwise and causing the striker 186 to ring the bell. As above mentioned the prolongation of rod 196 actuates counter 46 to register a score.

Pin Actuating Mechanism

For proper functioning of the machine there must be provided means for retracting the pins 38 when a coin is inserted in the chute 40 and the slide 42 advanced to the position shown in FIG. 5. Likewise there must be means for extending the pins after the wrestlers have used up the number of turns permitted by a single coin. Similarly, the trap doors must be unlocked so that they will function for the play and then relocked after the limit is reached.

The pin retracting and pad unlocking functions are actuated by the shifting of main drive bar 86 to the right i.e., to its position of FIG. 5, against the force of restoring spring 206. The opposite functions are performed when the bar 86 is shifted back to its original position by the spring 206.

Figure 9A:
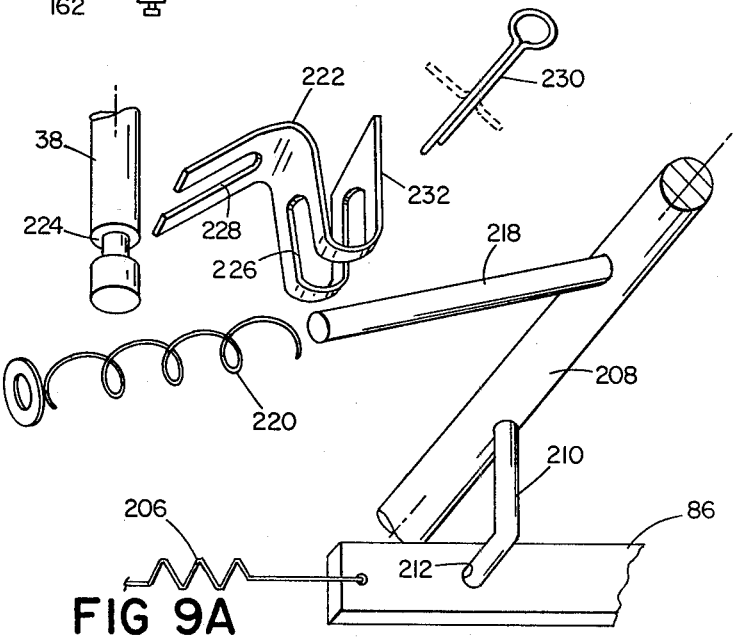
FIG. 9A is an exploded view in perspective of some of the operating elements shown in FIG. 9.

The bar 86 is pivotally connected to a series of transverse bars 208 by a series of cranks 210 each journaled at 212. The bars 208 are suitably journaled in fixed bearing members 214, 216 mounted on the bottom of the table 26 so that they may be revolved through a predetermined arc, clockwise to extend the pins 38 and counterclockwise to retract them. Referring now particularly to FIGS. 9 and 9A the crank action to accomplish this function will be clear. Each bar 208 carries a series of actuating arms 218 each surrounded by a coil spring 220 and carrying a slotted chip 222. The base of each pin 38 is provided with a circumferential groove 224. The pin 38 is assembled to the arm 218 as shown in FIG. 9, with the closed slot 226 embracing the arm 218 and held in place by cotter pin 230 and the portion 232 of clip 222 bearing against and holding the end of compressed spring 220 on arm 218. The open slot 228 in clip 222 engages the groove 224 in pin 38. Thus, when bars 208 are revolved clockwise, as seen in FIG. 9, the pins 38 are extended up through openings 88 and when they are revolved counterclockwise the pins are retracted so as not to interfere with the wrestlers' elbows resting on the table surface.

Figure 12:
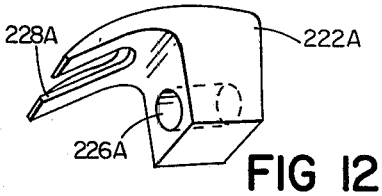
FIG. 12 is a view in perspective of an optional alternative part for one of those shown in FIG. 9A.

An alternative to clip 222 is shown in FIG. 12. It is a member 222A resembling a claw hammer head. The internal bore 226A replaces the closed slot of the clip 222 and is dimensioned to fit the arm 218. The claws define a slot 228A which performs the same function as slot 228.

The need for an open slot 228 is apparent because of the geometry of the arrangement. As the pins 38 go up or down there must be some lost motion in the slots 228. The function of the springs 220 is to provide some resilience to the operation and prevent jams.

It is clear from the above that the function of retracting the pins, which spoil the playing surface, is simply performed by shifting the bar 86 to the right. This results from inserting a coin and pushing in slide 42. We will now describe the function of re-extending the pins when three scores have been registered. For this purpose it is clear that means must be provided to count the number of "falls" and to release the bar 86, after a predetermined number have been registered, so that it will be shifted to the left, as seen in FIG. 9, by spring 206 to re-extend the pins. Likewise the "trap doors" must be locked until a new coin is inserted, and this is done by locking the rod 126 in the position shown in FIG. 8 whereby it will prevent the depending arm 150 from descending through the slot 160. Similarly rod 192 cannot move until a coin is inserted and it prevents pad 32 from being pushed down.

In FIG. 10A the mechanism is in condition to function. Each time a "fall" is registered by one or the other of pads 32, 34 swinging down, not only does the bell ring but the clockwise pivotal motion of arm 180 pushes rod 234 to the left. This is true because rod 234 is pivoted to arm 180 at its extremity 236. The other end of rod 234 is pivoted to arm 238 at 240. Arm 238 pivots counterclockwise about fixed point 242. Since its lower end is pivoted to the left end of bar 244, this motion is transmitted to bar 244 which shifts to the right against the force of spring 246. The action also stretches spring 248 which is connected between a point 250 above fixed point 242 on arm 238 and a point 252 on bar 244. The projecting end 254 of bar 244 is urged upwardly by spring 248 so that when bar 244 shifts to the right it engages a tooth 260 of toothed wheel 256 which can revolve on fixed axis 258. Wheel 256 is provided with a predetermined number of teeth 260. Upon either wrestler scoring a point, the bar 244 turns the wheel one step counterclockwise. A short tripping bar 262 is mounted to turn with the wheel 256. Each end of bar 262 is identical and carries a tripping projection 264. Since, in this instance, the wheel 256 carries six teeth it will be revolved through one hundred eighty degrees for each three "falls," thereby revolving bar 262 from the position shown in FIG. 10A to that shown in FIG. 10B to trip the hair trigger mechanism which releases the main actuating bar 86 so that spring 206 may retract and shift it to locked position shown in FIG. 10B. The hair trigger mechanism will now be described.

The hair trigger mechanism is indicated generally by the numeral 266. It consists of three links 268, 270 and 272. Links 268 and 272 are pivoted at their centers to a fixed portion of the machine and the whole assembly is urged upwardly by spring 274 which connects link 270 to a fixed anchor. The right hand end 276 of link 272 is notched, as indicated, and is arranged to engage upstanding projection 278 on keeper member 280 which is clamped to rod 86. Thus, when the parts are in operative condition of FIG. 10A the notched end 276 engages the projection 278 and holds bar 86 from moving to the left under the influence of spring 206. It is apparent that if the free end 282 of link 268 is lifted the hair trigger mechanism will quickly shift from its position of FIG. 10A to that of FIG. 10B and the notched end 276 of link 272 will be lifted away from projection 278 thereby releasing bar 86 to move to the left. The free end 282 is lifted by one or the other of the tripping projections 264 on bar 262 after each three movements of bar 244 which have served to revolve wheel 256 through one hundred eighty degrees.

Resetting of the hair trigger is accomplished when bar 86 is shifted to the left from its position in FIG. 10B to that of FIG. 10A by operation of slide 42. Since the linkages comprising the hair trigger mechanism are urged clockwise by spring 274, notched end 276 of link 272 will be resiliently depressed and will ride over and then engage upstanding projection 278 when bar 86 shifts to the right so as to keep it there until the trigger mechanism is again tripped.

An upstanding arm 284 is mounted to swing on fixed pivot 286 and has its lower end pivotally connected to an anchoring member or keeper 288 which, in turn, is clamped to move with bar 86. A dogged nose 290 on the upper right hand end of member 284 will swing between the two positions shown in full lines and dotted lines in FIG. 10B and will, at the end of play, engage tooth 291 on bar 244, thereby locking all systems due to the presence of keeper 288 on bar 86.

Elevating Mechanism

Since the persons wishing to try their strengths against each other will no doubt be of varying heights, it is important to provide mechanism for elevating and lowering the table 26. This mechanism is shown in FIG. 3. Each leg or pedestal 22, 24 is composed of a pair of telescoping cylindrical tubes. Pedestal 22 comprises lower cylinder 292 within which is telescoped upper cylinder 294. Similarly, pedestal 24 is formed of cylinders 296 and 298. Mounted at a convenient height above the floor on each lower tube 22, 24 is a worm driven toggle drive 300, 302 suitably connected to raise and lower the table. Each driving device 300, 302 is constructed and arranged to swing a driving lever 304, 306 up or down depending on the direction of revolution of the actuating bar 308 which is turned one way or the other by handle 310. To the outer end of each lever 304, 306 is pivoted an arm 310, 312 the upper end of which is connected to the top of its respective cylinder 294 or 298 on which the table 26 is supported. Locking screws, not shown, are actuated by handles 314, 316 to lock the table in any desired elevated position. For the convenience of repeat participants, a color coding device 318, comprising pointer 320 and colored markings 322, is provided on one of the telescoping legs to indicate the height of the table for present and future use.

Operation

The use of the arm wrestling machine will be briefly described.

If the machine is installed in an amusement center, its functioning should be apparent to the patrons without the need for explanation by an attendant. The color coding of the table top and base platform, together with the logos, representing human forearms, on the base platform, perform this function. The prospective contestants are thus shown where to stand and what the machine is for.

After the wrestlers have adjusted and locked the table at a height convenient for both of them, a coin is inserted in the chute 40 and slide 42 shifted all the way forward. By the corresponding movements of bars 86 and 70 the scoring devices are shifted to zero, the pins 38 retracted and the "trap doors" placed in ready position. The counting mechanism of FIGS. 10A and 10B is adjusted to count the "falls" and to restore the device to inoperative condition after three "falls" are scored altogether by the contestants against each other. Each time a contestant "pins" his opponent's forearm down so as to depress one of the pads 32, 34 the bell rings and an appropriate score is registered on one of the scoring devices 44, 46. After the third "fall" the hair trigger mechanism 266 is tripped, main bar 86 is shifted by spring 206 to inoperative position, the pins are extended to spoil the smooth surface of the table and no further arm wrestling can be performed without inserting another coin. Cumulative scores and team scores for each side may be kept by means of devices 50, 54.

While there has been disclosed and described a presently preferred embodiment of the invention it will, nevertheless, be understood that the same is susceptible of modifications and changes by those skilled in the art.

By way of non-limiting examples, it is within the contemplation of the invention to substitute other sensing means for the swinging pads shown in the preferred embodiment, such as light or heat sensing means; electrical pressure switches; hydraulic devices actuated by the pressure of the losing contestant's arm, and so on. The means for rendering the "playing" surface unusable may comprise panels which rise from the surface like venetian blinds when actuated or covers which move into place over the surface, or other equivalent spoilers. There may be substituted for the mechanical rod and link actuating mechanism such equivalent expedients as electrical, electronic, hydraulic or electrical-mechanical devices, with or without the use of micro-switches, or the like, or various of the foregoing in various combinations, all arranged to accomplish the same result. The score signalling means need not be confined to a bell or gong, for other audible signals and/or visual displays, such as colored flashing lights, may be employed. The coin operated means for unlocking the machine and retracting the spoilers may be entirely mechanical, as shown, or may be, in whole or in part, electrical, electronic or hydraulic in character for accomplishing the same result. Likewise, the means for raising and lowering the table may be mechanical, electrical or hydraulic, or any combination thereof, and the means for indicating the adjusted height may be any suitable mechanical, electrical or hydraulic indicating means.

It is, therefore, intended that the scope of the invention be limited only by the proper interpretation to be afforded the appended claims.

I claim:

1. Arm wrestling apparatus comprising a table provided with an elbow supporting flat surface for the elbows of a pair of contestants, sensing means mutually spaced on said surface arranged to be engaged by the hand, wrist or forearm of a losing contestant, and means responsive to said sensing means for signalling the scoring of a point in favor of the winner, said sensing means comprising a pair of angularly adjustable pads each hingedly mounted on said table surface and adapted to move from an elevated position to a depressed position when engaged by a portion of the arm of a contestant and said apparatus including rod means interconnecting said pads and said point scoring means.

2. Arm wrestling apparatus comprising a table with an elbow supporting flat surface for the elbows of a pair of contestants, mutually spaced yieldable pads arranged on said surface to be engaged and depressed by the hand, wrist or forearm of the losing contestant, a signalling device to signal each point scored, a scoring device to keep score for each contestant, a counting device to count the aggregate number of points scored, linkage interconnecting said pads and said devices to actuate the latter, retractable spoilers for said surface, means for locking said yieldable pads and interconnecting linkage against movement and means to activate said locking means after a predetermined aggregate number of points have been scored.

3. Apparatus according to claim 2 wherein said table is mounted on adjustable legs extending upward from a wide flat, rigid base adapted to rest on the floor, said base having extended areas on either side of said table on which the contestants may stand, whereby the weight of the contestants will add to the stability of the apparatus when in use, said base and the surface of said table being color coded to indicate to the contestants where to stand and the functions of any mechanisms on the table top and and the upper surface of said base being provided with visible indicia to indicate to the contestants the purpose of the apparatus.

* * * * *